US005947621A

United States Patent [19]

Szekely

[11] Patent Number: 5,947,621

[45] Date of Patent: Sep. 7, 1999

[54] COSMETIC DISPENSER FOR GELS AND CREMES INCLUDING METHOD OF ASSEMBLING AND LOADING THE DISPENSER

[75] Inventor: Alex S. Szekely, Manalapan, N.J.

[73] Assignee: The Plastek Group, Erie, Pa.

[21] Appl. No.: 08/806,904

[22] Filed: Feb. 26, 1997

[51] Int. Cl.[6] ..... A45D 40/06; A45D 40/04

[52] U.S. Cl. ..... 401/68; 401/75; 401/175

[58] Field of Search ..... 401/68, 75, 79, 401/175

[56] References Cited

U.S. PATENT DOCUMENTS

| | | | |
|---|---|---|---|
| 2,917,765 | 12/1959 | Jakubowski | 401/175 |
| 4,369,158 | 1/1983 | Woodruff et al. | 401/175 X |
| 4,545,696 | 10/1985 | Carluccio | 401/75 X |
| 4,664,547 | 5/1987 | Rosenwinkel | 401/175 |
| 5,547,302 | 8/1996 | Dornbusch et al. | 401/68 X |
| 5,753,212 | 5/1998 | Pescatore et al. | 401/68 X |

*Primary Examiner*—Steven A. Bratlie
*Attorney, Agent, or Firm*—Bachman & Lapointe, P.C.

[57] ABSTRACT

A dispenser for extruding cosmetic gels and cremes including a description of basic sub-assemblies, method of loading the dispenser and method of combining the sub-assemblies.

12 Claims, 4 Drawing Sheets

COSMETIC DISPENSER FOR GELS AND CREMES INCLUDING METHOD OF ASSEMBLING AND LOADING THE DISPENSER

FIELD OF THE INVENTION

The present invention relates to cosmetic dispensers for extruding various gels and cremes for application to skin surfaces in response to operation of hand wheel.

BACKGROUND OF THE INVENTION

The art is replete with a variety of dispensers which employ a hand wheel for advancing cremes and gels many of which are complicated and expensive to manufacture and to assemble.

For example see U.S. Pat. No. 5,000,356 entitled Swivel-Up Type Dispensing Package issued Mar. 19, 1991 to R. C. Johnson et al.

The '356 disclosure embraces myriad piece parts as is apparent from am examination of eight (8) sheets of drawings.

BRIEF SUMMARY OF THE INVENTION

It is an object of this invention to provide a simplified hand wheel type dispenser which lends itself to ease of manufacture.

A further object of the invention is the provision of two basic sub-assemblies which can be shipped to a filling station thereby providing a convenient filling operation and thereafter a simple final assembly step.

A further feature of the invention has to do with the method of assembling the sub-assemblies prior to shipment to a filling station.

A further object of the invention is the provision of optional methods of filling the dispenser.

A dispenser embracing certain features of the present invention may comprise, a barrel means, a perforate applicator head enclosing the top end of said barrel means, a base plug enclosing the bottom end of said barrel means, a screw means, said screw means defining a threaded member, a hand wheel fixed to said screw means and an indexing tab associated with said hand wheel, said screw means being received in said base plug, retainer means on said screw means making physical contact with said base plug whereby said screw means is retained axially but is rotatable relative to said base plug, said base plug having a plurality of radially extending fins operable to engage said indexing tab in step by step fashion in response to rotation of said hand wheel, an elevator means received within said barrel and in threaded engagement with said screw means whereby extrudable material contained in said barrel means and in contact with said elevator means is advanced toward said perforate applicator head and extruded through said head as said hand wheel is indexed about said base plug.

A method embracing certain other features of the invention may comprise the steps of assembling a first sub-assembly, assembling a second sub-assembly, loading one sub-assembly and thereafter combining the sub-assemblies to provide a functional dispenser.

Another aspect of the invention relates to the option of filling a fully assembled dispenser or, in the alternative, filling one sub-assembly of the dispenser before final combination of the two sub-assemblies into a functional unit.

Other features and advantages of the present invention will become more apparent from an examination of the succeeding specification when read in conjunction with the appended drawings; in which;

BRIEF DESCRIPTION OF THE DRAWINGS

FIG. 3 A is an enlargement of a portion of FIG. 3;

DETAILED DESCRIPTION OP THE INVENTION

Figure 4:
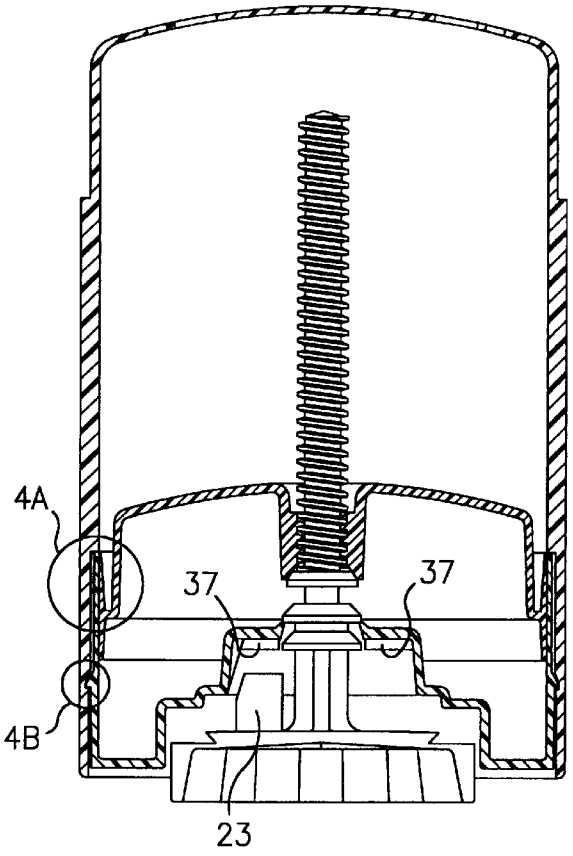
FIG. 4 is a vertical section of the assembled dispenser in the empty condition.

Referring to FIGS. 1 through 5A the reference numeral 10 designates a dispenser loaded with an appropriate gel or creme for a designated cosmetic application ready for customer use. The gel is an extrudable material with a viscosity in the range of 50,000 to 200,000 centipoise.

The dispenser includes a barrel 11, a hand wheel 12 a cap 13 and removable sealing tape 14 temporarily sealing extrusion openings 16—16. The dispenser is shipped with the tape in place and the customer removes and discards the tape before use.

Figure 2:
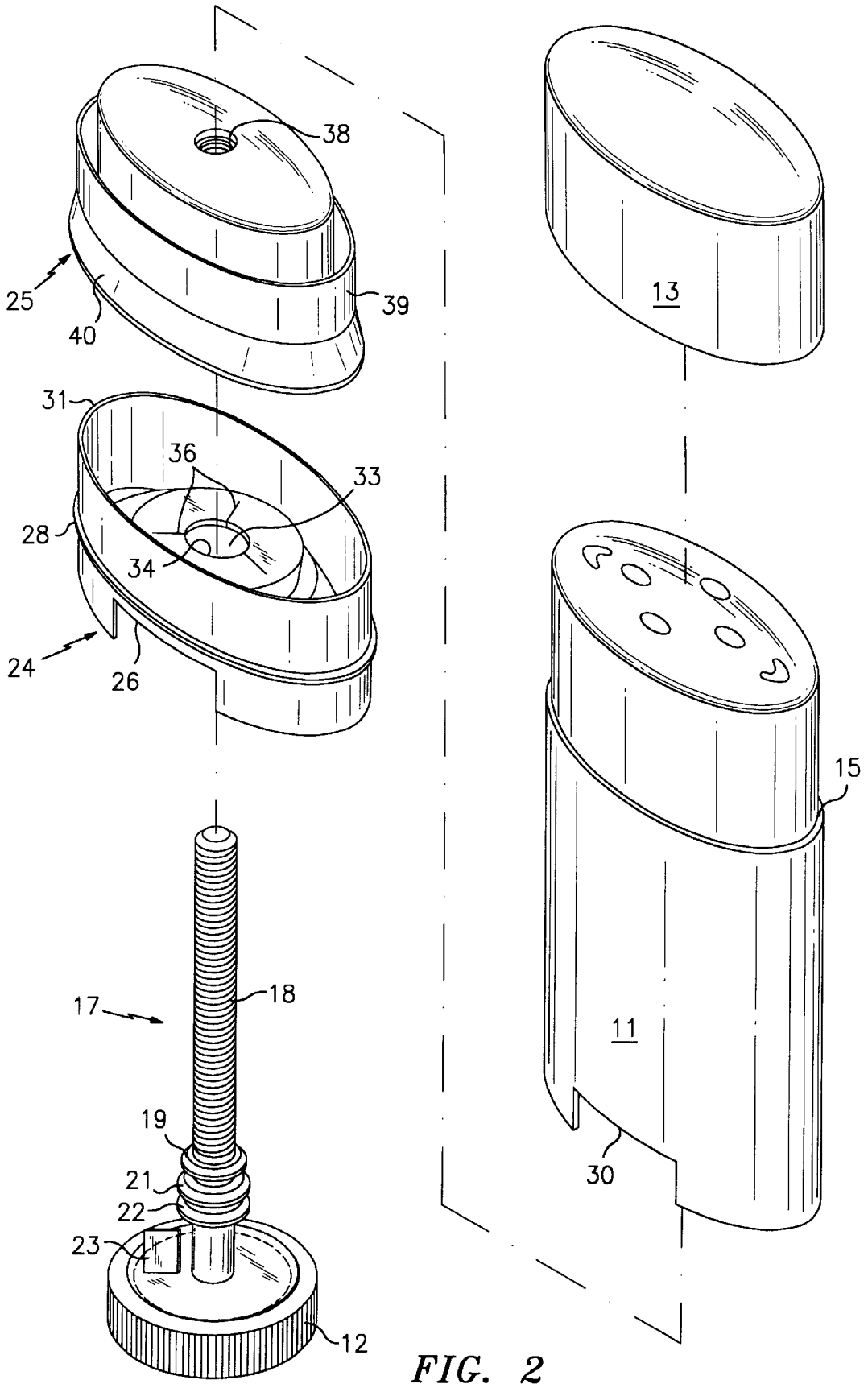
FIG. 2 is an exploded view of the showing of FIG. 1 illustrating the basic piece parts of the dispenser.

FIG. 2 shows in greater detail basic dispenser elements including screw means 17 having a threaded portion 18 a stop 19 and two snap rings 21 and 22, hand wheel 12 with an indexing tab 23, base plug 24, product elevator 25, barrel 11 and cap 13.

Figure 3:
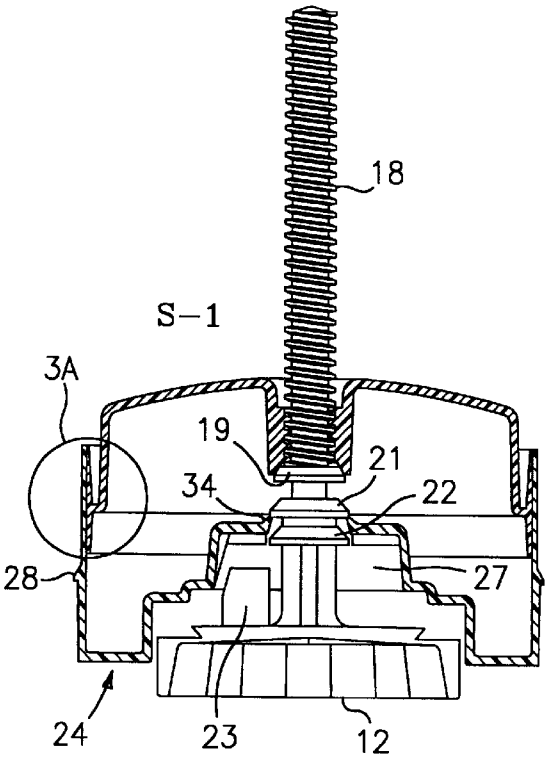
FIG. 3 shows a first sub-assembly including a screw means with hand wheel, retainers, stop, elevator and base plug.
Figure 1:
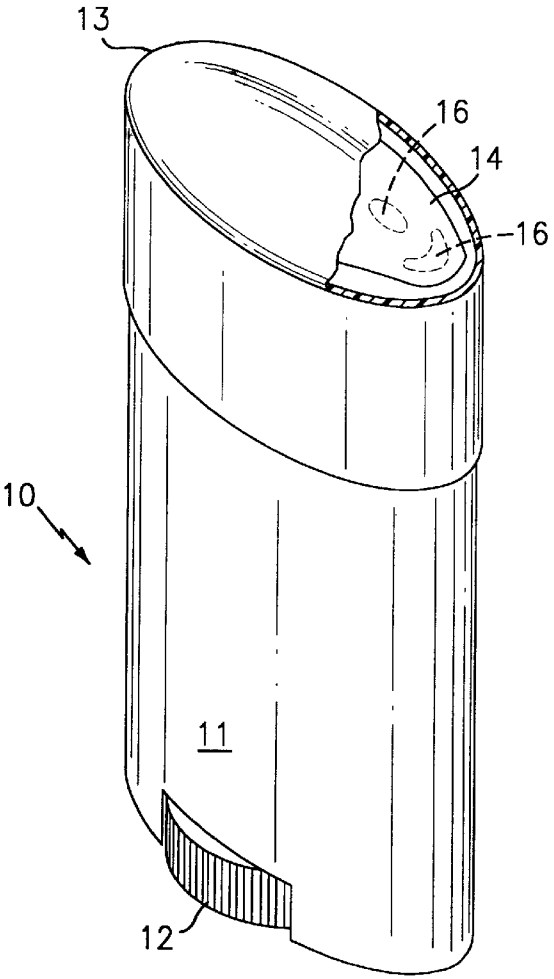
FIG. 1 is a perspective view of a loaded, capped dispenser ready for customer use with a portion of the cap broken away to show removable tape.

As is most apparent in FIGS. 2 and 3 the base plug 24 is formed with a cut-out 26 matching cut-out 30 in barrel 11 to accommodate the hand wheel 12. The base plug includes a recess 27 for receiving indexing tab 23 and a peripheral rim 28 for engaging a mating undercut 29 formed on the interior of the barrel as is most apparent in FIGS. 4 and 4B.

The base plug 24 includes an upwardly extending peripheral skirt 31 which bottoms on a peripheral shoulder 32 formed on the interior of the barrel when the base plug is inserted into the barrel. The enlargements of FIGS. 4A and 4B show that the cooperation of the rim 28 and the undercut 29 operate to retain the base plug within the barrel 11 while the bottoming of the skirt 31 upon the shoulder 32 limits the entry of the base plug into the barrel.

The base plug is formed with central bore 33 dimensioned to override snap rings 21 and 22 formed on the screw means.

That is, when the screw means and the base plug are assembled there is cooperation between the bore 33 and the snap rings 21 and 22.

Initially, the screw means is advanced axially into the recess 27 of the base plug until the periphery 34 of the bore 33 overrides the tapered snap ring 21 as shown in FIG. 3 to fix the screw means axially temporarily relative to the base plug while the screw means is free to rotate relative to the base plug.

Figure 4A:
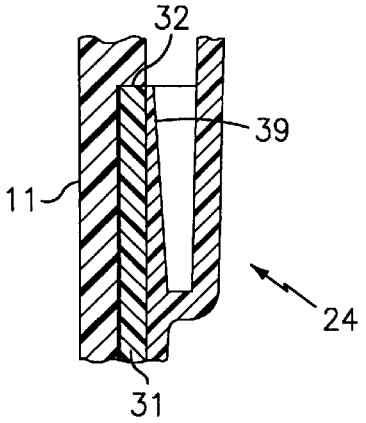
FIGS. 4A and 4B are enlargements of portions of FIG. 4.
Figure 4B:
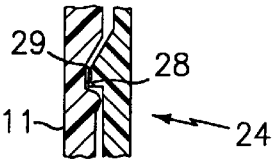
Figure 5A:
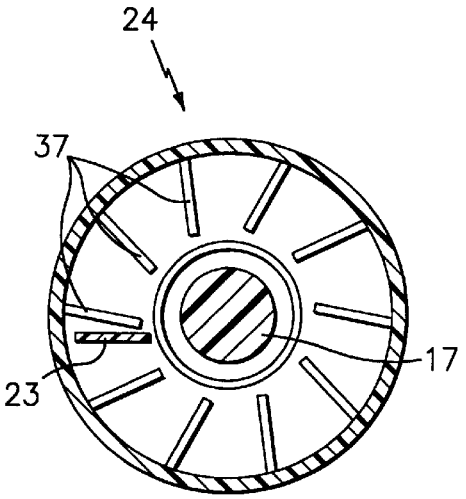
FIG. 5A is a sectional view of the illustration of FIG. 5 in the plane of the line 5—5 showing the step by step indexing means.

Note that the periphery or margin 34 of the bore 33 lies under the base of snap ring 21 as is most apparent in FIGS. 3 and 4 and the hand wheel 12 is not fully housed in the base plug.

This action is possible because the base plug is made of plastic with a fair amount of flexibility. The diameter of the bore 33 is slightly smaller than the overall diameter of the snap rings 21 and 22 so that one can drive (push) the screw means to override the snap ring to the position shown in FIGS. 3 and 4.

In some cases it may be necessary to provide radial slits 36 (FIG. 2) around the bore 33 to enhance flexibility.

Figure 5B:
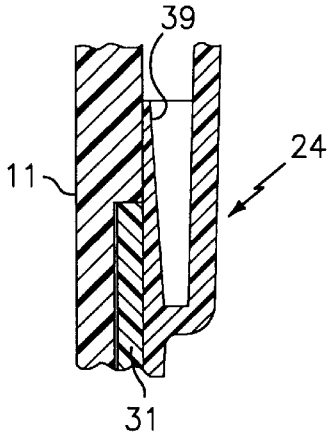
FIG. 5B is an enlargement of a portion of FIG. 5.
Figure 5:
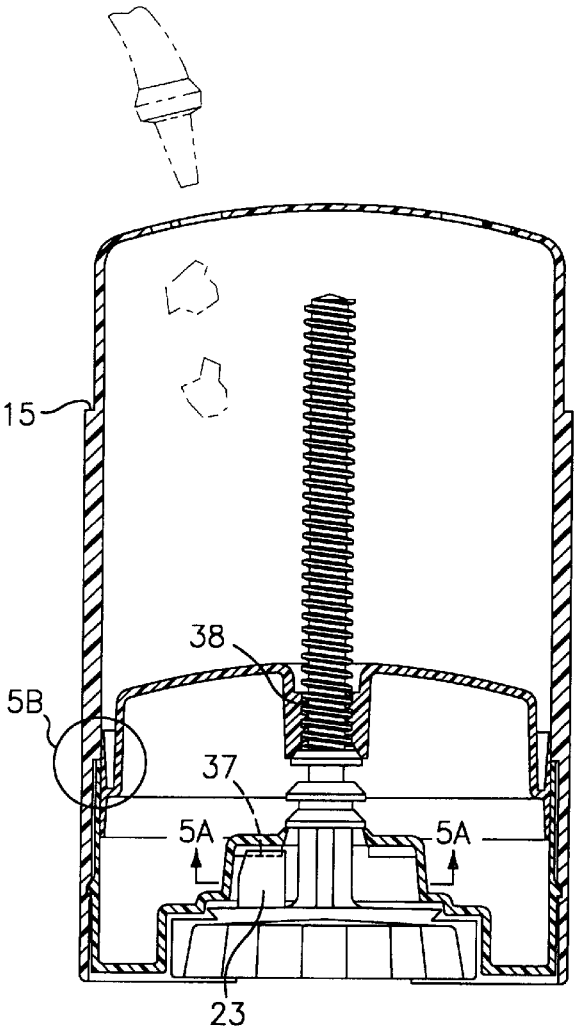
FIG. 5 shows top filling of the assembled dispenser.

As is most apparent in FIGS. 3, 4, 5 and 5A the underside of the base plug 24 is formed with a plurality of radially extending ribs 37 which when the dispenser is fully assembled (as shown in FIG. 5) cooperate with indexing tab 23 to act as a ratchet as the hand wheel is rotated.

Product elevator 25, threaded internally as at 38 to match threaded portion 18 of screw means 17, is used to lift product toward the extrusion openings 16 in a manner that will become more apparent as this specification proceeds.

The product elevator 25 is assembled to the base plug 24 and the screw means 17 by threadedly engaging the threaded portion 18 and winding the elevator along the thread portion 18 until the elevator reaches the stop 19. At this point the base plug 24, screw means 17 and elevator 25 are positioned relative to one another as shown in FIG. 3.

Figure 3A:
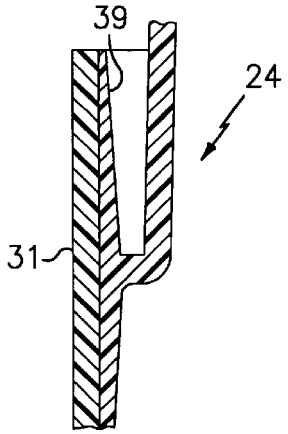

In the FIGS. 3 and 3A illustrations note that, at this time, a flexible peripheral upstanding wiper 39 is nested within and protected by the relatively rigid skirt 31 of the base plug 24. In fact, the top edge of the wiper is flush with or slightly below the top edge of the skirt 31.

The combination of elements shown in FIG. 3 is a basic sub-assembly and is referred to hereinafter as the first sub-assembly S-1 (FIG. 3). This sub-assembly comprises screw means 17, base plug 24 and product elevator 25.

A second sub-assembly S-2 (FIG. 6) comprises the cap 13, barrel 11 and sealing tape 14. Note that the cap 13 is adapted to fit over the top of the barrel coming to rest upon shoulder 15.

It is well to point out at this juncture that the dispenser is usually transported to a loading station in the form of the first and second sub-assemblies. Where the second sub-assembly is inverted and loaded as shown in FIG. 6 and thereafter, combined with the first sub-assembly as shown in FIG. 7.

Figure 6:
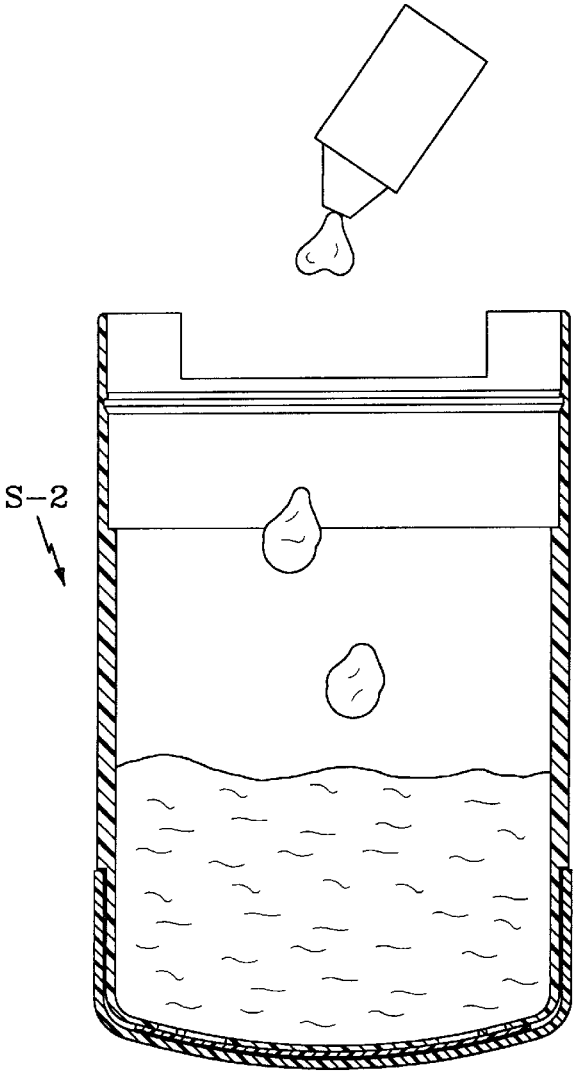
FIG. 6 shows a vertical section of a second sub-assembly inverted for product filling.
Figure 7:
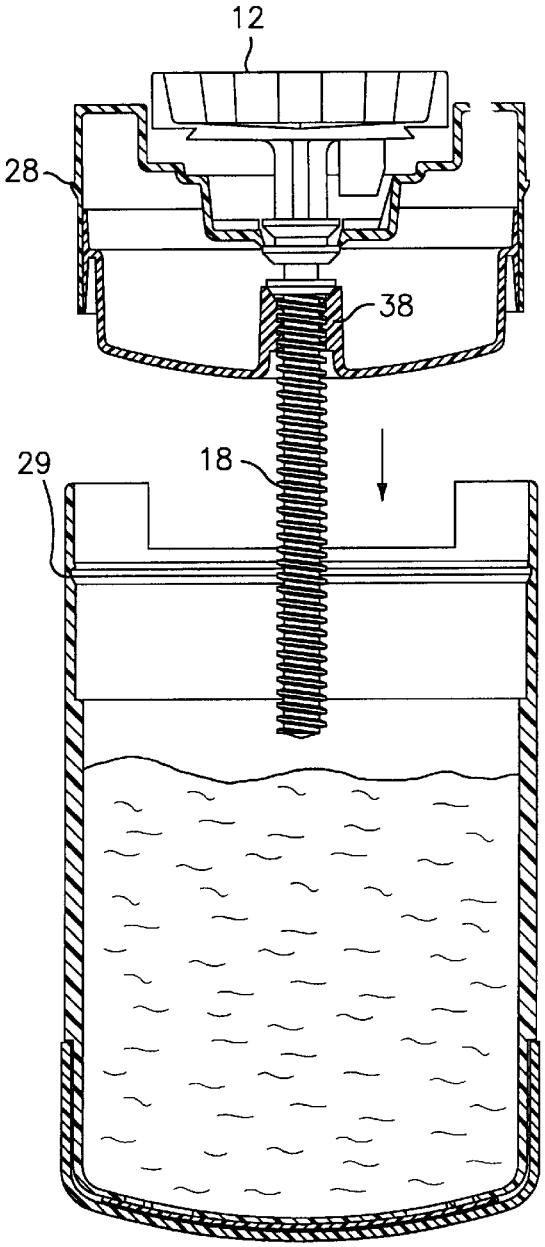
FIG. 7 shows the step of combining the two sub-assemblies after the filling step.

After the product loading step of FIG. 6 the two sub-assemblies are combined as shown in FIG. 7. Obviously the loading step involves a measured volume to make certain that there is adequate space for the first sub-assembly to be received and snapped into the second sub-assembly. Upon this occurrence the combined sub-assemblies are righted to the position and configuration of FIGS. 1 and 4. That is, the peripheral rim 28 of the base plug engages the barrel undercut 29 while the rigid skirt 31 of the base plug bottoms upon the internal shoulder 32 of the barrel (FIG. 4A).

In the FIGS. 4 and 4A combination note that at this time the top edge 41 of the wiper 39 is still flush with or slightly below the top edge of base plug skirt 31 and the screw means remains in engagement with the upper snap ring 21.

Next the screw means is pushed inwardly relative to the combined barrel and base plug so that the bore 33 overrides snap ring 22 and the hand wheel assumes a flush position as shown in FIGS. 5.

As a result of this occurrence the top edge 41 of the wiper 39 moves upwardly beyond the shoulder 32 as is apparent in FIGS. 5 and 5B.

Thus, in the FIG. 5 arrangement the dispenser is in an operative condition and rotation of the hand wheel 12 will advance the product elevator to extrude product through extrusion openings 16 while the wiper 39 and its flared lip 40 seal the elevator against the interior of the barrel thereby precluding product flow in the wrong direction.

The placement of the nozzle 42 in the FIG. 5 illustration is merely exemplary of an alternative method of loading the dispenser after combination of the sub-assemblies in the upright position.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A dispenser for applying extrudable material to a skin surface comprising:

a barrel having a top end and a bottom end, a perforate applicator head enclosing the top end of said barrel, a base plug enclosing the bottom end of said barrel, a screw means, said screw means comprising a threaded member, a hand wheel fixed to said threaded member, an indexing tab associated with said hand wheel, and an elevator stop member, said screw means being received in said base plug, retainer means on said threaded member defining an intermediate position for said base plug relative to said screw means wherein said screw means is retained axially but is rotatable relative to said base plug, said base plug having a plurality of radially extending fins operable to engage said indexing tab in step by step fashion in response to rotation of said hand wheel, an elevator means received within said barrel and in threaded engagement with said screw means whereby extrudable material contained in said barrel and in contact with said elevator means is advanced toward said perforate applicator head and extruded through said head as said hand wheel is indexed about said base plug, wherein said elevator stop member of said screw means engages said elevator means for limiting position of said elevator means relative to said screw means.

2. A dispenser of claim 1 wherein the retainer means comprises a first retainer and a second retainer.

3. The dispenser of claim 1 wherein the base plug is formed with a bore which is dimensioned to override the retainer means.

4. The dispenser of claim 3 wherein the base plug is formed with a bore having a plurality of radially extending slots to enhance the flexibility of said base plug in the region of said bore.

5. The dispenser of claim 1 which comprises two basic sub-assemblies.

6. The dispenser of claim 5 in which a first sub-assembly of said two basic sub-assemblies includes said base plug, said screw means and said elevator.

7. The dispenser of claim 6 in which a second sub-assembly includes a cap, said barrel and a seal tape.

8. The dispenser of claim 1 in which the retainer means comprises at least two snap rings.

9. The dispenser of claim 1 in which the retainer means defines at least two positions of the screw means relative to the base plug.

10. In a dispenser for applying extrudable material to a skin surface comprising two sub-assemblies, a first sub-assembly comprising screw means, a base plug and a product elevator, said screw means comprising a threaded portion, a stop, two snap rings and a hand wheel, said elevator having a wiper and internal threads operable to threadedly engage said threaded portion of said screw means, said base plug being formed with a skirt and with a central aperture for receiving said screw means and dimensioned to override said two snap rings, a method of assembling said first sub-assembly comprising the steps of:

inserting the screw means into the base plug through said central aperture so that the base plug overrides one of said two snap rings to fix the screw means axially and temporarily relative to the base plug between said two snap rings, threadedly engaging the product elevator and the threaded portion of the screw means, and rotating the product elevator relative to said threaded portion of the screw means until the elevator reaches said stop whereby the wiper of the product elevator is nested flush within the skirt of said base plug and the hand wheel is not fully housed.

11. The method of claim 10 plus the step of moving the screw means relative to the base plug so that the base plug overrides the other of said snap rings whereby a portion of the wiper moves beyond the skirt of the base plug and the hand wheel is fully housed.

12. The method of claim 10 wherein a second sub-assembly comprises a barrel having extrusion openings, a sealing tape for closing said extrusion openings and a cap for closing one end of said barrel and means for fixing the first and second sub-assemblies axially, further comprising the steps of:

loading said second sub-assembly with product, combining said first sub-assembly with said second sub-assembly, and thereafter moving said screw means relative to said base plug whereby said hand wheel is housed, said base plug overrides the other of said snap rings and a portion of the wiper emerges beyond the skirt.

* * * * *